United States Patent [19]

Galati

[11] 4,436,059

[45] Mar. 13, 1984

[54] FLUE CONDENSATE SHIELD

[75] Inventor: Antonio Galati, Toronto, Canada

[73] Assignee: Canadian Gas Research Institute, Don Mills, Canada

[21] Appl. No.: 371,641

[22] Filed: Apr. 26, 1982

[30] Foreign Application Priority Data

Jul. 31, 1981 [CA] Canada ..... 383072

[51] Int. Cl.[3] ..... F22B 5/00

[52] U.S. Cl. ..... 122/17; 122/16; 122/155 F

[58] Field of Search ..... 122/13 R, 14, 16, 17, 122/19, 160, 161

[56] References Cited

U.S. PATENT DOCUMENTS

| | | | |
|---|---|---|---|
| 1,804,123 | 5/1931 | Sponan | 122/17 |
| 1,948,064 | 2/1934 | Canter | 122/17 |
| 2,355,466 | 8/1944 | Perry | 122/155 F |
| 2,423,000 | 6/1947 | Bennett et al. | 122/161 |
| 2,440,998 | 5/1948 | Alexander | 122/16 |
| 3,060,921 | 10/1962 | Luring et al. | 122/32 |
| 3,124,108 | 3/1964 | Wenczl | 122/17 |
| 3,170,511 | 2/1965 | Guthrie | 122/17 |
| 3,718,544 | 2/1973 | Sims | 122/17 |

*Primary Examiner*—Henry C. Yuen

*Attorney, Agent, or Firm*—Arne I. Fors; Robert F. Delbridge

[57] ABSTRACT

A water heater tank having a vertical, open-ended flue formed by a cylindrical wall extending therethrough, a metal annulus formed at the bottom of the flue wall, said annulus being continuously affixed to or integral with the bottom of the flue wall for effective heat transfer from the annulus to the flue wall, said annulus having an upturned lip on the inner side thereof such that said annulus will collect and retain condensate forming on the flue wall for subsequent evaporation of said condensate.

2 Claims, 2 Drawing Figures

FLUE CONDENSATE SHIELD

Figure 1:
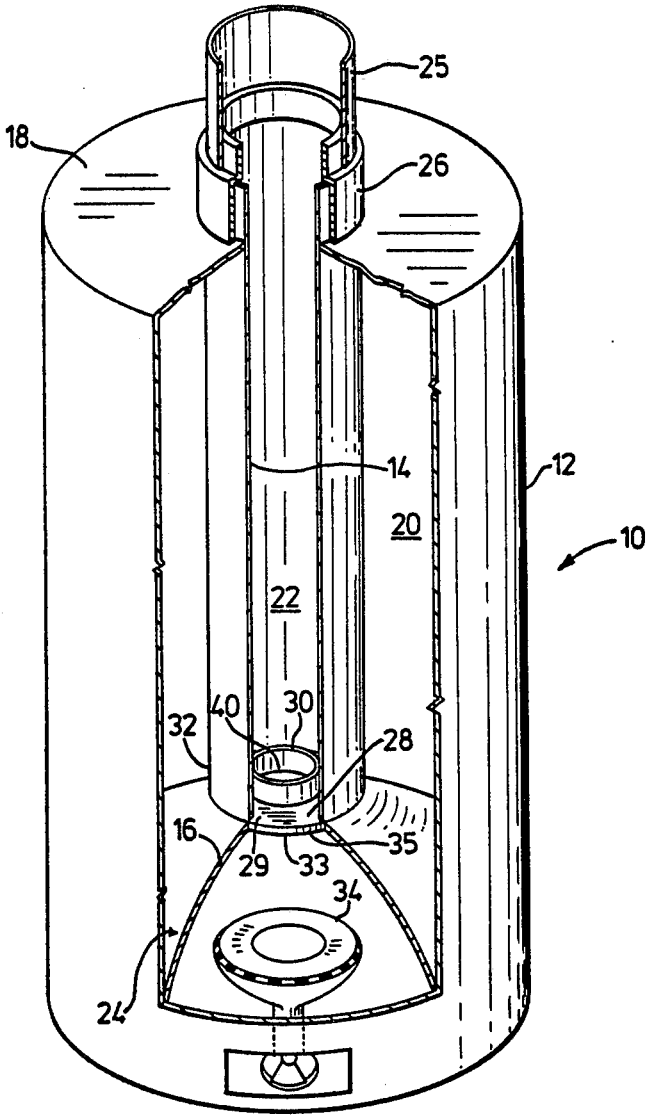

This invention relates to an improved water heater and, more particularly, relates to an improved water heater having a vertical flue in which hot combustion products of gaseous or liquid fuels provide heat for water contained in an annular water tank.

In improving the thermal efficiency of such water heaters, a limit to efficiency is reached at a point where condensation of the combustion products interferes with acceptable combustion of the fuel, producing undesirable quantities of carbon monoxide.

The production of water condensate on the flue wall of a water heater having the flue passing through the heater occurs at the initiation of a heating cycle when the tank contents are relatively cool or after the withdrawal of a large portion of hot water contained in a tank with replacement by cold water. High efficiency natural gas-fired heaters are particularly prone to condensation because of the high water vapour content in the combustion product and low flue gas temperature.

The presence of water condensate on the flue wall results in dripping of the condensate into the underlying combustion chamber or onto the burner to interfere with the combustion of fluid fossil fuels, producing undesirable quantities of carbon monoxide. It has been found that when high efficiency fossil fuel fired water heaters are tested for certification, the carbon monoxide concentration in the flue gases often exceeds a common maximum limit of 400 ppm air free during cold start tests. To overcome excessive production of carbon monoxide and to comply with maximum regulatory limits, the level of heat transfer from the flue gas to the flue wall has had to be curtailed to prevent unwanted condensation which, upon falling onto the burner or into the burner flame, caused the production of carbon monoxide. This preventive measure effectively imposes an undesirably low limit on thermal efficiency.

The use of a condensation drip pan secured to but spaced from the underside of a flue is known. U.S. Pat. No. 1,961,231 discloses a concavo-convex plate for collecting condensate for eventual evaporation. U.S. Pat. No. 2,162,620 shows another embodiment of cup-shaped member which constitutes a heat deflector and trap to receive condensation products which may drip from the flue. Another version of drip cup is disclosed in U.S. Pat. No. 910,796 for use in a gas water heater for accumulating condensate dripping from the surface of the heater for subsequent evaporation.

The dish-shaped structures shown in the aforementioned patents are intended to serve a dual function of deflecting combustion products away from the centre of a combustion chamber while accumulating condensate dripping from a flue. The spacing of a deflector-collector, or shield, from the bottom of a flue allows the shield to assume the temperature of the hot gases in the combustion chamber and, in that the shield would become very hot towards the end of a heating cycle, the metal of the shield would be subjected to accelerated oxidation and scaling with subsequent premature failure and interference with the burner operation. Also, the use of a dish-shaped structure to deflect combustion products outwardly provides an undesirable restriction to gas flow to render the use of high pressure drop, high efficency flue baffles unsuitable.

We have found that the presence of an annular trough, i.e. an annulus with an upturned lip on the inner diameter, at the bottom of the flue wall for collecting condensate during the initial heat-up stage of a heating cycle for subsequent evaporation of the condensate when the combustion chamber and flue wall reach a higher temperature, not only prevents the dripping of condensate onto an underlying burner or into the flame in a combustion chamber but also permits removal of excessive heat from the annulus by conduction to the flue wall to substantially lengthen the life of the condensate collector. By preventing the condensate from coming into contact with either the flame or burner, carbon monoxide concentrations within the flue gases have been found to remain at an acceptable low level during initial heat-up of the heater water, thus permitting the use of a more restrictive but more efficient flue baffle resulting in enhanced heat transfer from the combustion gases to the heater water chamber. We have also found that the annular trough does not interfere with or deflect the path of the combustion products within the combustion chamber.

In accordance with the present invention there is provided in a water heater comprising, in combination, a water heater tank having a vertical, open-ended flue formed by a cylindrical wall extending therethrough, said flue adapted to receive hot combustion gases for heating said tank, a metal annulus having an outer side and an inner side formed at the bottom of the flue wall, said annulus being continuously affixed to or integral with the bottom of the flue wall on the annulus outer side for effective heat transfer from the annulus to the flue wall and said annulus having an upturned lip on the inner side thereof such that said annulus will collect and retain condensate forming on the flue wall for subsequent evaporation of said condensate. A preferred embodiment of the annulus occupies from about 40 to 60% of the sectional area of the flue.

It is a principal object of the present invention to provide a simple durable annular shield at the bottom of the flue wall of a water heater which can be inexpensively formed as part of or secured to the flue wall to collect and retain condensate formed on the flue wall and to permit effective heat transfer from the shield to the flue wall.

Figure 2:
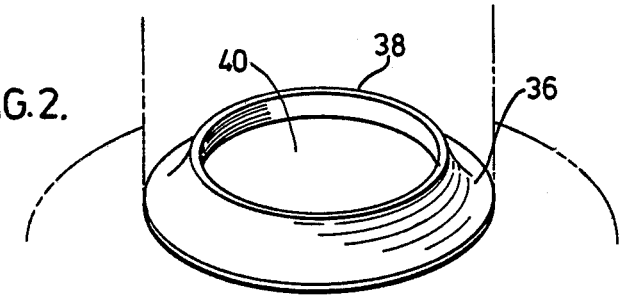

The foregoing and other objects of the invention and the manner in which they can be attained will become apparent from the following detailed description of the drawing, in which:

FIG. 1 is a perspective view, partly cut away, of an embodiment of our invention illustrating the structural arrangement of component parts; and FIG. 2 is a fragmentary view of another embodiment of the condensate shield of the present invention.

With reference to FIG. 1 of the drawing, the hot water tank depicted by numeral 10 comprises an outer cylindrical wall 12 and an inner cylindrical wall 14 disposed concentric with outer wall 12 and joined thereto by lower closure wall 16 and upper closure wall 18 defining annular water chamber 20 therebetween.

The central opening formed by inner wall 14 defining an open-ended flue 22 is in communication with a combustion chamber designated by numeral 24 from which hot combustion products from the burning of natural gas, propane, fuel oil, and the like fossil fuels are discharged for egress through flue 22 which is connected, at its upper end, with a vent 25 by means of a draft hood 26.

A metal annulus 28 formed integral with or secured to the bottom 32 of cylindrical wall 14 on the inner open side thereof has an upturned inner lip 30 of a height sufficient to collect and retain condensate rolling down the wall 14 for subsequent evaporation of the condensate by conduction of heat from gas burner 34. The outer side 29 of annulus 28 continuously abuts the bottom 32 of cylindrical wall 14 about circumferential juncture 33 to provide good heat transfer from the annulus to the flue wall. Metal annulus 28 normally abuts and press fits flue wall 14 and is continuously secured thereto by a weld along juncture 33, or is formed integral therefrom by rolling or stamping annulus 28 and lip 30 from the material of wall 14.

FIG. 2 shows another embodiment of our invention in which annulus 36 has an arcuate upturned lip 38 formed on the inner side thereof for the retention of condensate collected in annulus 36. Annulus 36 is formed integral with or secured to the bottom 32 of flue wall 14 in the manner described above.

The dimensions of the opening 40 within annulus 28 or annulus 36, and hence the width of each annulus, and the height of inner lips 30, 38, respectively, are important. Opening 40 must be large enough not to cause an undesirable restriction or obstruction to the flow of combustion products, yet must be small enough that adequate storage capacity of condensate is available in the annuli during the initial heating stages of water in the tank when the flue wall is cold and condensate is formed. The heights of the lips 30, 38 in combination with the sectional areas of the annuli 28, 36 must define sufficient capacity so that collected condensate does not rise over the lips and spill onto the burner and flames below. A wider annulus, necessitating a smaller diameter opening 40 in the centre of the flue, provides a more shallow tray for the same volume of retained condensate, permitting faster evaporation. An annulus condensate holding capacity of about 0.3 cubic inch per 1,000 BTU/h of fuel input is satisfactory.

I have found that the provision in a gas-fired high efficiency domestic water heater of 33,000 BTU/h input, with a 5" nominal flue diameter, of a metal annulus having an inside diameter of 3¼", and a lip 1½" high produces surprising improvement in the combustion performance of the heater. Without the annular shield, air free carbon monoxide concentrations of up to 700 ppm were recorded during combustion tests. With the provision of a shield according to the present invention occupying 43% of the flue area, and having a condensate retaining capacity of 10.5 cubic inches, i.e. about 0.3 cubic inch per 1,000 BTU/h fuel, the carbon monoxide concentration did not exceed 100 ppm air free. Since the maximum allowable concentration of carbon monoxide is 400 ppm air free, the heater would not be approved without the shield. To obtain similar acceptable combustion characteristics without the shield, the heat transfer efficiency, i.e. as controlled by the flue baffle, must be reduced by as much as 2 percentage points.

I have found the same performance efficiency to be obtained with domestic water heaters with a 6" monimal flue diameter and high efficiency flue baffle.

It will be understood that modifications can be made in the embodiment of the invention illustrated and described herein without departing from the scope and purview of the invention as defined by the appended claims.

What I claim as new and desire to protect by Letters Patent of the United States is:

1. An improved water heater comprising, in combination, a water heater tank having a vertical, open-ended flue formed by a cylindrical wall extending therethrough defining an inner wall of the tank adjacent water in the tank, said flue adapted to receive hot combustion gases for heating the water in said tank, a metal annulus having an outer side and an inner side formed at the bottom of the flue wall, said annulus being continuously affixed to and abutting the flue wall on the annulus outer side for effective heat transfer from the annulus to the flue wall and to water in said tank, said annulus having an upturned lip on the inner side thereof such that the annulus will collect and retain condensate forming on the flue wall for subsequent evaporation of said condensate, said annulus occupying from about 40 to about 60% of the sectional area of the flue and having a condensate holding capacity of about 0.3 cubic inch per 1,000 BTU/h of fuel input.

2. An improved water heater as claimed in claim 1 wherein said annulus is formed integral with the bottom of the flue wall.

* * * * *